US012790781B2

(12) United States Patent
Moroi et al.

(10) Patent No.: US 12,790,781 B2
(45) Date of Patent: Nov. 10, 2026

(54) AUGER DEVICE OF SNOWPLOW

(71) Applicant: HONDA MOTOR CO., LTD., Tokyo (JP)

(72) Inventors: Atsushi Moroi, Saitama (JP); Takuma Kimoto, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 306 days.

(21) Appl. No.: 18/688,971

(22) PCT Filed: Sep. 6, 2021

(86) PCT No.: PCT/JP2021/032699
§ 371 (c)(1),
(2) Date: Mar. 4, 2024

(87) PCT Pub. No.: WO2023/032212
PCT Pub. Date: Mar. 9, 2023

(65) Prior Publication Data

US 2024/0392521 A1 Nov. 28, 2024

(51) Int. Cl.
*E01H 5/09* (2006.01)

(52) U.S. Cl.
CPC ..... *E01H 5/098* (2013.01)

(58) Field of Classification Search
CPC .... E01H 5/04; E01H 5/07; E01H 5/09; E01H 5/092; E01H 5/098
See application file for complete search history.

(56) References Cited

U.S. PATENT DOCUMENTS 5,123,186 A * 6/1992 Matushita ..... E01H 5/04 37/251
2004/0172859 A1* 9/2004 Sakai ..... E01H 5/04 37/242
2004/0172861 A1 9/2004 Sakai et al.

FOREIGN PATENT DOCUMENTS

JP H03137311 A 6/1991
JP 2001020239 A 1/2001
JP 2001020240 A 1/2001
JP 2006257836 A 9/2006

OTHER PUBLICATIONS

Written Opinion for PCT/JP2021/032699 mailed Nov. 16, 2021; 6 pps.

* cited by examiner

*Primary Examiner* — Robert E Pezzuto
(74) *Attorney, Agent, or Firm* — Armstrong Teasdale LLP

(57) ABSTRACT

An auger device of a snowplow includes: an auger shaft; an auger claw fixed to the auger shaft; and a pair of side disks arranged on both outsides of the auger claw in a prescribed direction and fixed to the auger shaft, wherein each of the pair of side disks is spaced at an interval from the auger claw, and an auxiliary claw protruding inward in the prescribed direction is provided on an inner surface of each of the pair of side disks.

8 Claims, 8 Drawing Sheets

Y
102A
102
86A
104
102A
102B
106
R1
87
36
68
93
33
88
96
92
106
106
95
91
35
34
81
86
102

AUGER DEVICE OF SNOWPLOW

CROSS-REFERENCE TO RELATED APPLICATION

This application is a U.S. National Phase Application of PCT/JP2021/032699, filed on Sep. 6, 2021, which is hereby expressly incorporated by reference in its entirety.

TECHNICAL FIELD

The present invention relates to an auger device of a snowplow.

BACKGROUND ART

Conventionally, a snowplow is provided with an auger device to crush and collect the snow in front of the snowplow.

For example, Patent Document 1 discloses a snowplow that includes an auger shaft extending horizontally across an auger housing, a plurality of auger claws attached to the auger shaft to crush and collect the snow, and side disks attached to both ends of the auger shaft so as to cut into the snow near side walls of the auger housing while functioning as protectors of the auger claws.

PRIOR ART DOCUMENT(S)

Patent Document(s)

Patent Document 1: JP2006-257836A

SUMMARY OF THE INVENTION

Task to be Accomplished by the Invention

In a case where the auger claw and the side disks are made of different materials, the auger claw and the side disks may not be able to be welded together depending on the combination of the materials. In such a case, it is preferable to space the side disks at an appropriate interval (clearance) from the auger claw so as to suppress the contact between the side disks and the auger claw due to the dimensional variations at the time of manufacture or the elastic deformation of the auger claw during snow removal work. However, if the side disks are spaced at an interval from the auger claw as described above, an area where the snow cannot be crushed is generated between the side disks and the auger claw, which may decrease the work efficiency (the efficiency to crush the snow) of the auger device.

In view of the above background, an object of the present invention is to provide an auger device that can suppress a decrease in the work efficiency while spacing the side disks at an interval from the auger claw.

Means to Accomplish the Task

To achieve such an object, one aspect of the present invention provides an auger device (7) of a snowplow (1), comprising: an auger housing (31); an auger shaft (33) supported by the auger housing so as to be rotatable around an axial line (X) extending in a prescribed direction; an auger claw (34) fixed to the auger shaft; and a pair of side disks (35) arranged on both outsides of the auger claw in the prescribed direction and fixed to the auger shaft, wherein each of the side disks is spaced at an interval from the auger claw, and an auxiliary claw (102) protruding inward in the prescribed direction is provided on an inner surface of each of the side disks.

According to this aspect, the auxiliary claw can crush the snow that enters the gap between each of the side disks and the auger claw. Accordingly, it is possible to suppress a decrease in the work efficiency (the efficiency to crush the snow) of the auger device while spacing each of the side disks at an interval from the auger claw.

In the above aspect, preferably, the auger claw is inclined outward in the prescribed direction with respect to a rotational direction thereof, and the auxiliary claw is arranged adjacently to an end portion (86A) of the auger claw on an outside in the prescribed direction.

According to this aspect, since the gap between the end portion of the auger claw on the outside in the prescribed direction and the auxiliary claw can be narrowed, it is possible to more effectively suppress a decrease in the work efficiency of the auger device.

In the above aspect, preferably, the auxiliary claw is arranged on an extended line of the end portion of the auger claw on the outside in the prescribed direction.

According to this aspect, the auger claw can smoothly convey the snow crushed by the auxiliary claw toward the inside in the prescribed direction.

In the above aspect, preferably, the auxiliary claw is provided with an inclined surface inclined outward in the prescribed direction with respect to the rotational direction of the auger claw.

According to this aspect, the auger claw can more smoothly convey the snow crushed by the auxiliary claw toward the inside in the prescribed direction.

In the above aspect, preferably, the auxiliary claw is spaced at an interval (Y) with respect to a circumferential direction of the auger shaft from the end portion of the auger claw on the outside in the prescribed direction.

According to this aspect, in a case where the auger claw elastically deforms toward the outside in the prescribed direction, it is possible to inhibit the end portion of the auger claw on the outside in the prescribed direction from contacting with the auxiliary claw.

In the above aspect, preferably, the auger device further comprises a pair of connecting members (36) connecting the auger shaft and the pair of side disks, wherein each of the connecting members includes a plurality of connecting shafts (106) extending in a radial direction of the auger shaft in a side view, and one of the plurality of connecting shafts is arranged on an inside of the auxiliary claw in the radial direction.

According to this aspect, since the connecting shaft is hidden on the inside of the auxiliary claw in the radial direction, the connecting shaft is unlikely to inhibit the auxiliary claw from cutting into a snow surface.

In the above aspect, preferably, the auxiliary claw is formed separately from each of the side disks and joined to the inner surface of each of the side disks.

According to this aspect, it is possible to increase the flexibility in the shape of the auxiliary claw as compared with a case where the auxiliary claw is formed integrally with each of the side disks.

In the above aspect, preferably, the auxiliary claw is composed of a plate member that curves so as to be convex inward in the prescribed direction, and both end portions (102A) of the auxiliary claw in a circumferential direction of the auger shaft are joined to the inner surface of each of the side disks, and a space (S) that opens outward in a radial direction of the auger shaft is formed between each of the side disks and the auxiliary claw.

According to this aspect, since the auxiliary claw is composed of a plate member, it is possible to reduce the weight and cost of the auxiliary claw. Further, as the auxiliary claw curves so as to be convex inward in the prescribed direction and the space is formed between each of the side disks and the auxiliary claw, it is possible to improve the ability of the auxiliary claw to cut into the snow surface.

In the above aspect, preferably, a portion of the auxiliary claw protrudes further toward an outer circumferential side than an outer circumferential edge portion of each of the side disks.

According to this aspect, since the portion of the auxiliary claw can contact with the snow surface before each of the side disks contacts therewith, it is possible to crush the snow efficiently.

Effect of the Invention

Thus, according to the above aspects, it is possible to provide an auger device that can suppress a decrease in the work efficiency while spacing the side disks at an interval from the auger claw.

BRIEF DESCRIPTION OF THE DRAWING(S)

MODE(S) FOR CARRYING OUT THE INVENTION

In the following, a snowplow 1 according to an embodiment of the present invention will be described with reference to the drawings. Hereinafter, terms indicating directions such as "front", "rear", "left", "right", "upper", and "lower" will be used based on the direction seen from a worker operating the snowplow 1. An arrow Fr appropriately attached to each figure indicates the front of the snowplow 1, an arrow I appropriately attached to each figure indicates the inside or inward in the lateral direction of the snowplow 1, and an arrow O appropriately attached to each figure indicates the outside or outward in the lateral direction of the snowplow 1.

Figure 1:
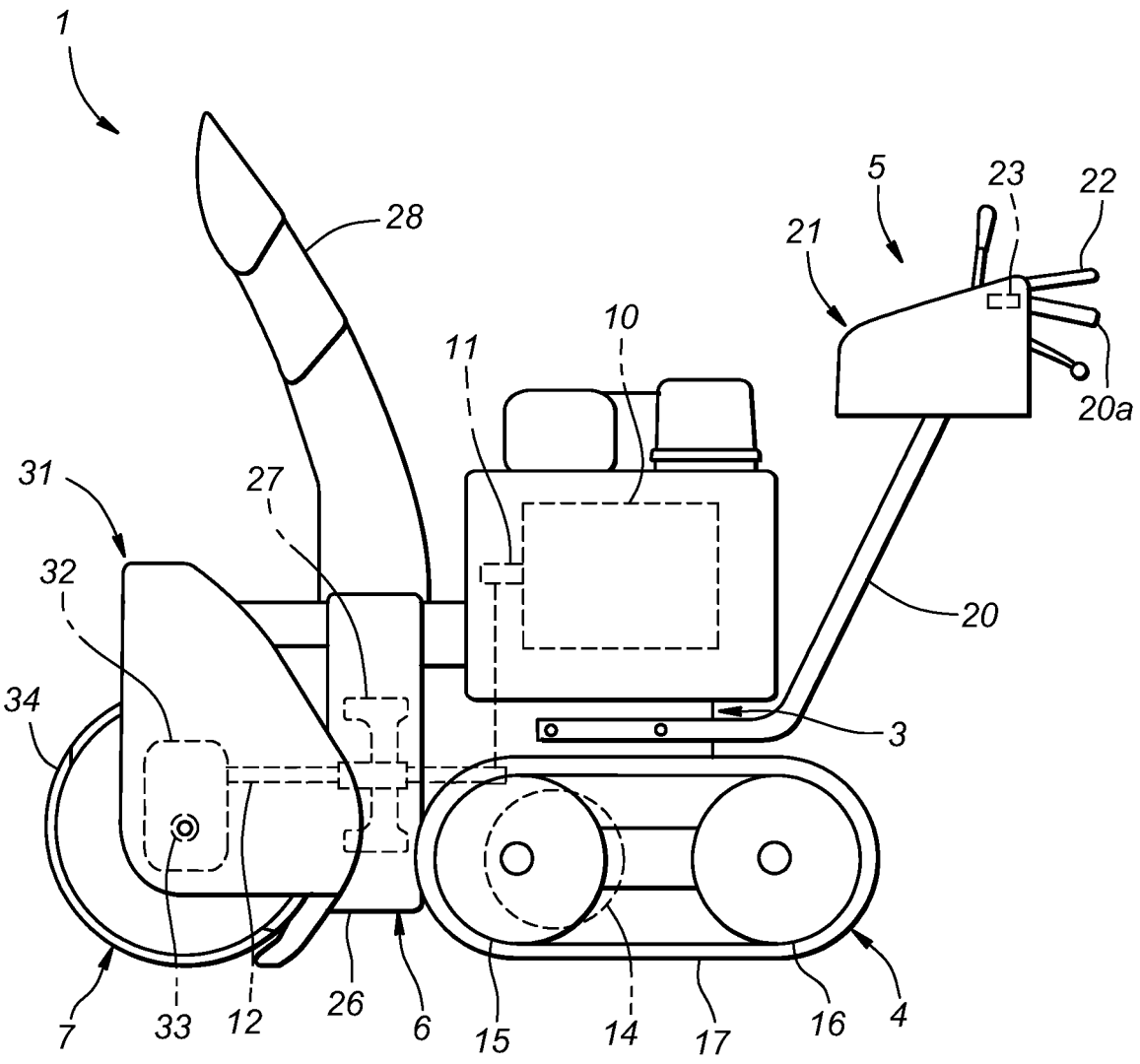
FIG. 1 is a side view showing a snowplow according to an embodiment of the present invention.

First, the overall configuration of the snowplow 1 will be described with reference to FIG. 1.

The snowplow 1 is a walking type snowplow with which the worker performs snow removal work while walking behind it. The snowplow 1 includes a plow body 3 that constitutes the skeleton thereof, a pair of travel devices 4 provided on both left and right sides of the plow body 3 (in FIG. 1, only the travel device 4 provided on the left side of the plow body 3 is shown), a handle device 5 provided behind the plow body 3, a blower device 6 provided in front of the plow body 3, and an auger device 7 provided in front of the blower device 6.

An internal combustion engine (hereinafter referred to as "the engine 10") is supported by an upper portion of the plow body 3. The engine 10 includes a crankshaft 11 (in FIG. 1, only a front end portion thereof is shown) that is rotatable around an axial line extending in the front-and-rear direction. In another embodiment, the crankshaft 11 may be rotatable around an axial line extending in the up-and-down direction. A transmission shaft 12 that is rotatable around an axial line extending in the front-and-rear direction is provided in front of a lower portion of the plow body 3. The transmission shaft 12 is connected to the crankshaft 11 via a speed reduction mechanism (not shown).

Each travel device 4 includes a travel motor 14, a driving wheel 15 connected to the travel motor 14, a driven wheel 16 provided behind the driving wheel 15, and a crawler belt 17 wound around the driving wheel 15 and the driven wheel 16. In another embodiment, the driven wheel 16 may be provided in front of the driving wheel 15.

The handle device 5 includes left and right arms 20 (in FIG. 1, only the left arm 20 is shown) extending rearward and upward from the lower portion of the plow body 3, and an input device 21 attached to upper end portions of the left and right arms 20. The upper end portion of each arm 20 is provided with a grip 20*a* to be gripped by the worker. The input device 21 is a device that accepts an input operation by the worker. The input device 21 includes, for example, a travel lever 22 that accepts a travel operation of the snowplow 1, and a snow removal switch 23 that accepts an activating operation of the blower device 6 and the auger device 7.

The blower device 6 includes a blower housing 26 fixed to a front portion of the plow body 3, a blower 27 accommodated in the blower housing 26, and a chute 28 extending upward from an upper end of the blower housing 26. The blower 27 is fixed to a rear portion of the transmission shaft 12.

The auger device 7 includes an auger housing 31 fixed to a front portion of the blower housing 26, a transmission 32 accommodated in the auger housing 31, an auger shaft 33 rotatably supported by the auger housing 31, and an auger claw 34 fixed to the auger shaft 33. The auger shaft 33 is connected to the transmission shaft 12 via the transmission 32. Details of the auger device 7 will be described later.

Next, the overall operation of the snowplow 1 will be described.

When the worker performs the travel operation of the snowplow 1 on the travel lever 22 of the input device 21, the travel motor 14 of each travel device 4 rotates. The rotation of the travel motor 14 is transmitted to the crawler belt 17 via the driving wheel 15, and the crawler belt 17 rotates. Accordingly, the snowplow 1 travels.

Further, when the worker performs the activating operation of the blower device 6 and the auger device 7 on the snow removal switch 23 of the input device 21, the crankshaft 11 of the engine 10 rotates. The rotation of the crankshaft 11 is transmitted to the transmission shaft 12 via the speed reduction mechanism (not shown), and the transmission shaft 12 and the blower 27 rotate integrally. The rotation of the transmission shaft 12 is transmitted to the auger shaft 33 via the transmission 32, and the auger shaft 33 and the auger claw 34 rotate integrally. As the auger claw 34 rotates, the snow in front of the snowplow 1 is crushed by the auger claw 34 and collected at the lateral center of the auger housing 31. This collected snow is introduced into the blower housing 26 and is thrown in a desired direction by the blower 27 via the chute 28.

Next, the configuration of the auger device 7 will be described in detail.

Figure 2:
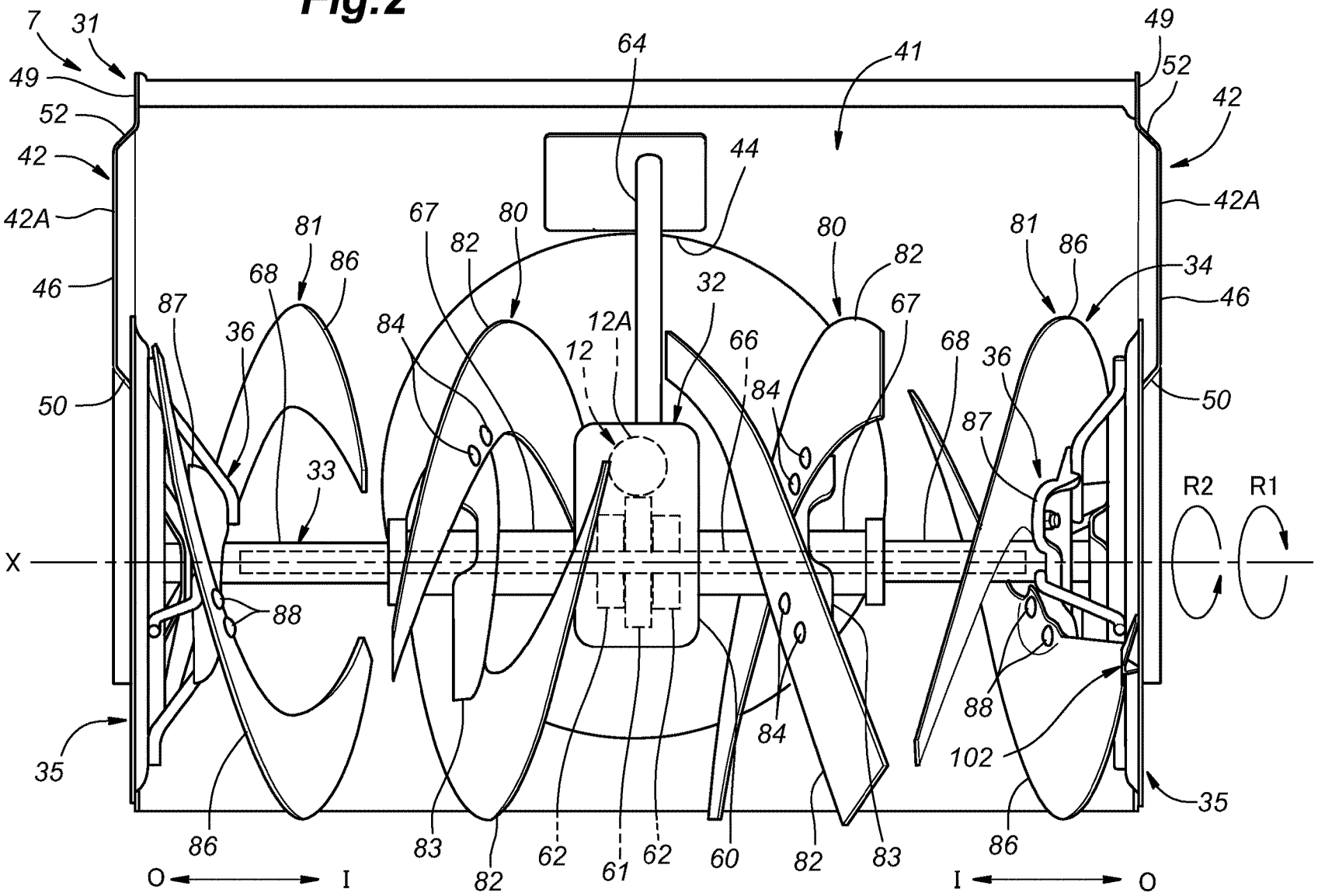
FIG. 2 is a front view showing an auger device according to the embodiment of the present invention.
Figure 3:
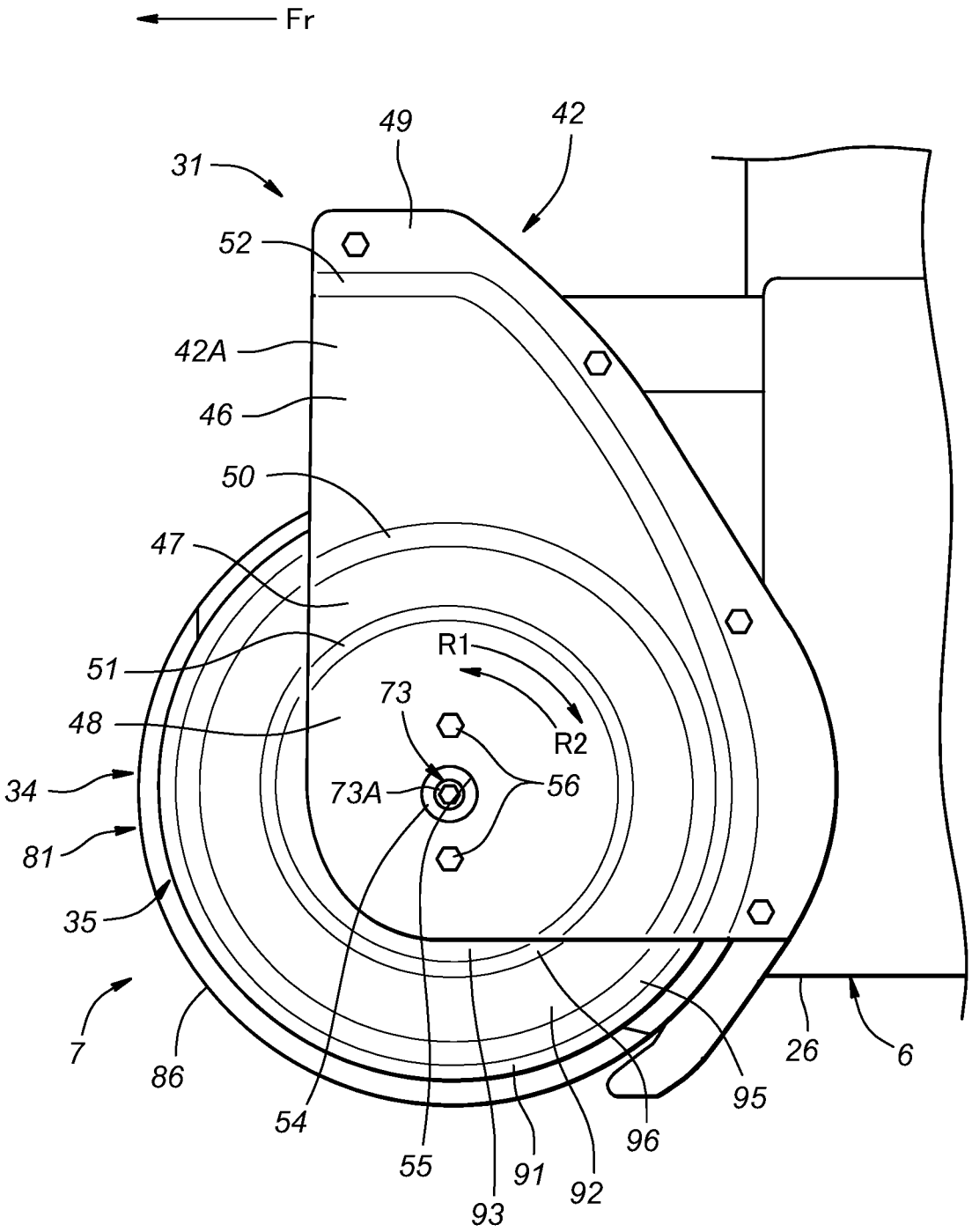
FIG. 3 is a side view showing the auger device according to the embodiment of the present invention.

With reference to FIGS. 2 and 3, the auger device 7 includes, in addition to the auger housing 31, the transmission 32, the auger shaft 33, and the auger claw 34 mentioned above, a pair of side disks 35 arranged on both left and right outsides of the auger claw 34 and fixed to the auger shaft 33, and a pair of connecting members 36 connecting the auger shaft 33 and the pair of side disks 35. Hereinafter, a simple expression "radial direction" or "circumferential direction" will refer to the radial direction or the circumferential direction of the auger shaft 33.

The auger housing 31 of the auger device 7 has a box shape that is open forward and downward. The auger housing 31 includes a main plate 41 extending in the lateral direction, and a pair of side plates 42 fixed to both left and right end portions of the main plate 41.

The main plate 41 defines upper and rear surfaces of the auger housing 31. A circular communication hole 44 is provided in a laterally central portion of the main plate 41, and a space inside the auger housing 31 and a space inside the blower housing 26 (see FIG. 1) communicate with each other via the communication hole 44.

Figure 4:
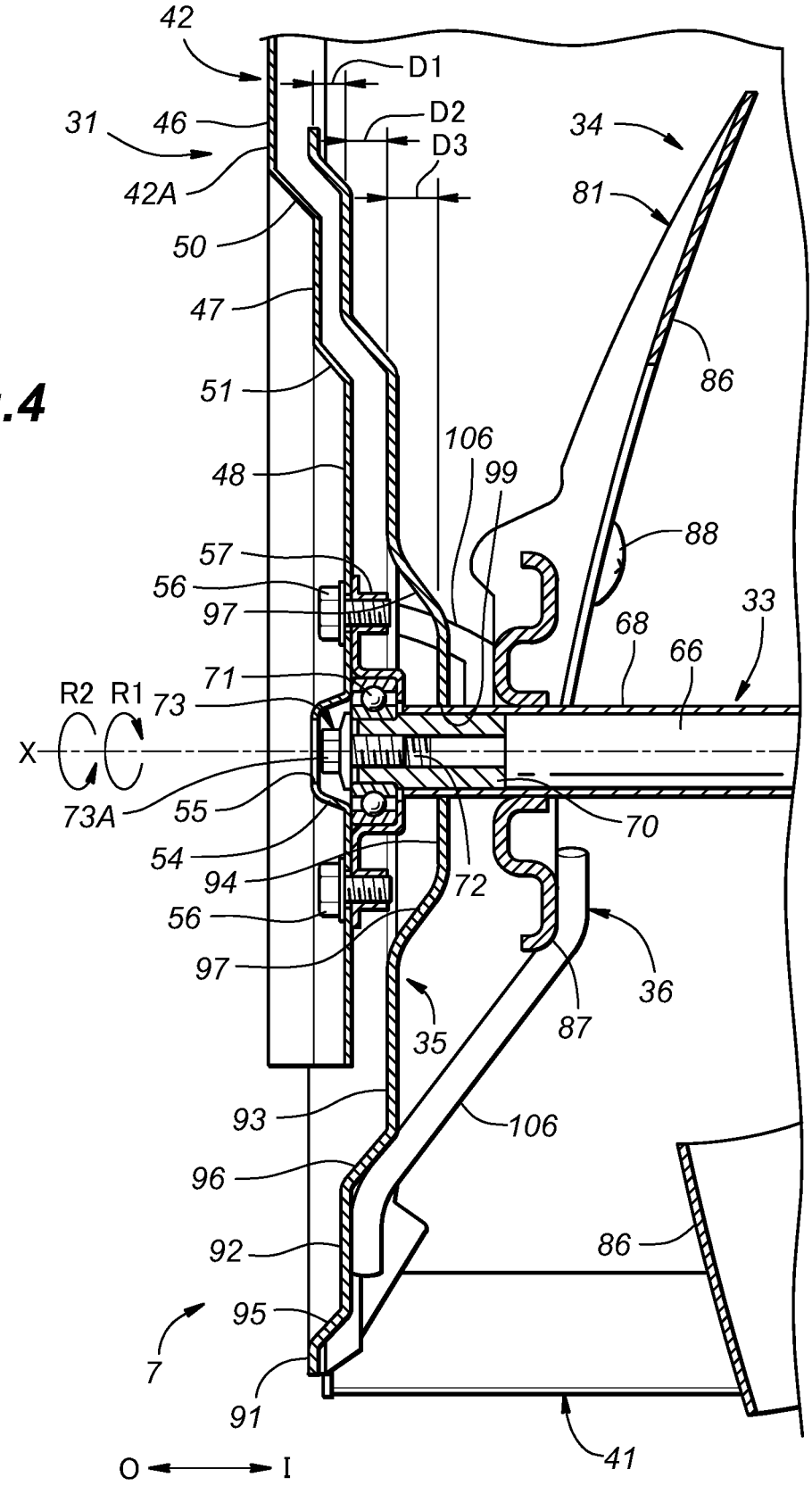
FIG. 4 is a cross-sectional view showing a side disk and its periphery according to the embodiment of the present invention.

With reference to FIGS. 2 to 4, the pair of side plates 42 define both left and right side surfaces of the auger housing 31. The pair of side plates 42 are bilaterally symmetrical to each other.

Each side plate 42 includes a first flat plate portion 46 defining the outermost surface 42A (the outermost surface in the lateral direction) thereof, a second flat plate portion 47 arranged closer to the inside in the lateral direction and the inside in the radial direction than the first flat plate portion 46, a third flat plate portion 48 arranged closer to the inside in the lateral direction and the inside in the radial direction than the second flat plate portion 47, a fourth flat plate portion 49 arranged closer to the outside in the radial direction and the inside in the lateral direction than the first flat plate portion 46, a first connecting portion 50 connecting the first flat plate portion 46 and the second flat plate portion 47, a second connecting portion 51 connecting the second flat plate portion 47 and the third flat plate portion 48, and a third connecting portion 52 connecting the first flat plate portion 46 and the fourth flat plate portion 49.

The first to fourth flat plate portions 46 to 49 are provided along a plane perpendicular to the lateral direction. A bulging portion 54 that bulges outward in the lateral direction is provided in the center of the third flat plate portion 48. A through hole 55 is provided in the center of the bulging portion 54. A supporting bracket 57 is fixed to an inner surface of the third flat plate portion 48 via a pair of bolts 56.

The first to third connecting portions 50 to 52 are inclined with respect to a plane perpendicular to the lateral direction. More specifically, the first and second connecting portions 50 and 51 are inclined inward in the radial direction toward the inside in the lateral direction, and the third connecting portion 52 is inclined outward in the radial direction toward the inside in the lateral direction.

With reference to FIG. 2, the transmission 32 of the auger device 7 is accommodated in the laterally central portion of the auger housing 31. The transmission 32 includes a gear case 60, a first driving gear 61 accommodated in the gear case 60, and a pair of second driving gears 62 accommodated in the gear case 60 and arranged on both left and right outsides of the first driving gear 61.

The gear case 60 is suspended at a central upper portion of the main plate 41 of the auger housing 31 via an attachment bracket 64 extending in the up-and-down direction.

The first driving gear 61 meshes with a transmission gear 12A provided on the transmission shaft 12, and is configured to rotate in a first rotational direction R1 (in the present embodiment, the clockwise direction when viewed from the left side) according to the rotation of the transmission shaft 12.

Each second driving gear 62 is connected to the first driving gear 61 via a pair of idle gears (not shown), and is configured to rotate in a second rotational direction R2 (in the present embodiment, the counterclockwise direction when viewed from the left side) opposite to the first rotational direction R1 according to the rotation of the first driving gear 61.

The auger shaft 33 of the auger device 7 extends along the lateral direction. The auger shaft 33 is supported by the auger housing 31 so as to be rotatable around an axial line X extending in the lateral direction. The auger shaft 33 includes a main shaft portion 66, a pair of inner shaft portions 67 provided around both left and right side portions of the main shaft portion 66, and a pair of outer shaft portions 68 arranged on both left and right outsides of the pair of inner shaft portions 67.

The main shaft portion 66 has a solid rod shape. The main shaft portion 66 penetrates through the gear case 60 of the transmission 32 in the lateral direction. The main shaft portion 66 is fixed to the first driving gear 61 of the transmission 32 and is configured to rotate integrally with the first driving gear 61 in the first rotational direction R1.

Each inner shaft portion 67 has a pipe shape. Each inner shaft portion 67 is not fixed to the main shaft portion 66, and is provided so as to be rotatable relative to the main shaft portion 66. Each inner shaft portion 67 is fixed to the second driving gear 62 corresponding with respect to the lateral direction, and is configured to rotate integrally with the second driving gear 62 in the second rotational direction R2.

With reference to FIGS. 3 and 4, each outer shaft portion 68 has a pipe shape. A lateral end portion of the main shaft portion 66 is fitted into a laterally inside portion of each outer shaft portion 68. Accordingly, each outer shaft portion 68 is fixed to the main shaft portion 66 and configured to rotate integrally with the main shaft portion 66 in the first rotational direction R1. A cylindrical attachment piece 70 is fitted into a laterally outside portion of each outer shaft portion 68. The attachment piece 70 is attached via a bearing 71 to the supporting bracket 57 fixed to each side plate 42 of the auger housing 31. Accordingly, the auger shaft 33 is rotatably supported by the pair of side plates 42. A female screw 72 is provided on an inner circumferential surface of the attachment piece 70, and a bolt 73 screws into the female screw 72 from the outside in the lateral direction. A head 73*a* of the bolt 73 is accommodated in the bulging portion 54 of each side plate 42, and locks the bearing 71 from the outside in the lateral direction.

With reference to FIG. 2, the auger claw 34 of the auger device 7 is an auger claw of the so-called cross auger type, and is made of spring steel. The auger claw 34 includes a pair of inner claw portions 80 arranged on both left and right outsides of the transmission 32, and a pair of outer claw portions 81 arranged on both left and right outsides of the pair of inner claw portions 80. Each inner claw portion 80 and each outer claw portion 81 are not connected to each other, and are spaced at an interval in the lateral direction.

Each inner claw portion 80 is composed of a pair of inner blades 82 arranged at different angular positions in the circumferential direction. Each inner blade 82 has a substantially C-shape in a side view. An outer edge portion of each inner blade 82 has an arc shape centered on the auger shaft 33. Each inner blade 82 is fixed via a pair of bolts 84 to an inner bracket 83 fixed to an outer circumferential surface of each inner shaft portion 67 of the auger shaft 33. Accordingly, each inner blade 82 is removably fixed to each inner shaft portion 67 via the inner bracket 83, and is configured to rotate integrally with each inner shaft portion 67 in the second rotational direction R2. Each inner blade 82 is inclined outward in the lateral direction with respect to the second rotational direction R2.

Each outer claw portion 81 is composed of a pair of outer blades 86 arranged at different angular positions in the circumferential direction. Each outer blade 86 has a substantially C-shape in a side view. An outer edge portion of each outer blade 86 has an arc shape centered on the auger shaft 33. Each outer blade 86 is fixed via a pair of bolts 88 to an outer bracket 87 fixed to an outer circumferential surface of each outer shaft portion 68 of the auger shaft 33. Accordingly, each outer blade 86 is removably fixed to each outer shaft portion 68 via the outer bracket 87, and is configured to rotate integrally with each outer shaft portion 68 in the first rotational direction R1. Each outer blade 86 is inclined outward in the lateral direction with respect to the first rotational direction R1. That is, each outer blade 86 is inclined in the opposite direction to each inner blade 82.

The pair of side disks 35 of the auger device 7 are arranged on the outside in the lateral direction of the pair of outer claw portions 81 of the auger claw 34 with a gap therebetween. In other words, the pair of side disks 35 are not welded to the auger claw 34. The pair of side disks 35 are arranged on the inside in the lateral direction of the pair of side plates 42 of the auger housing 31 with a gap therebetween.

Figure 5:
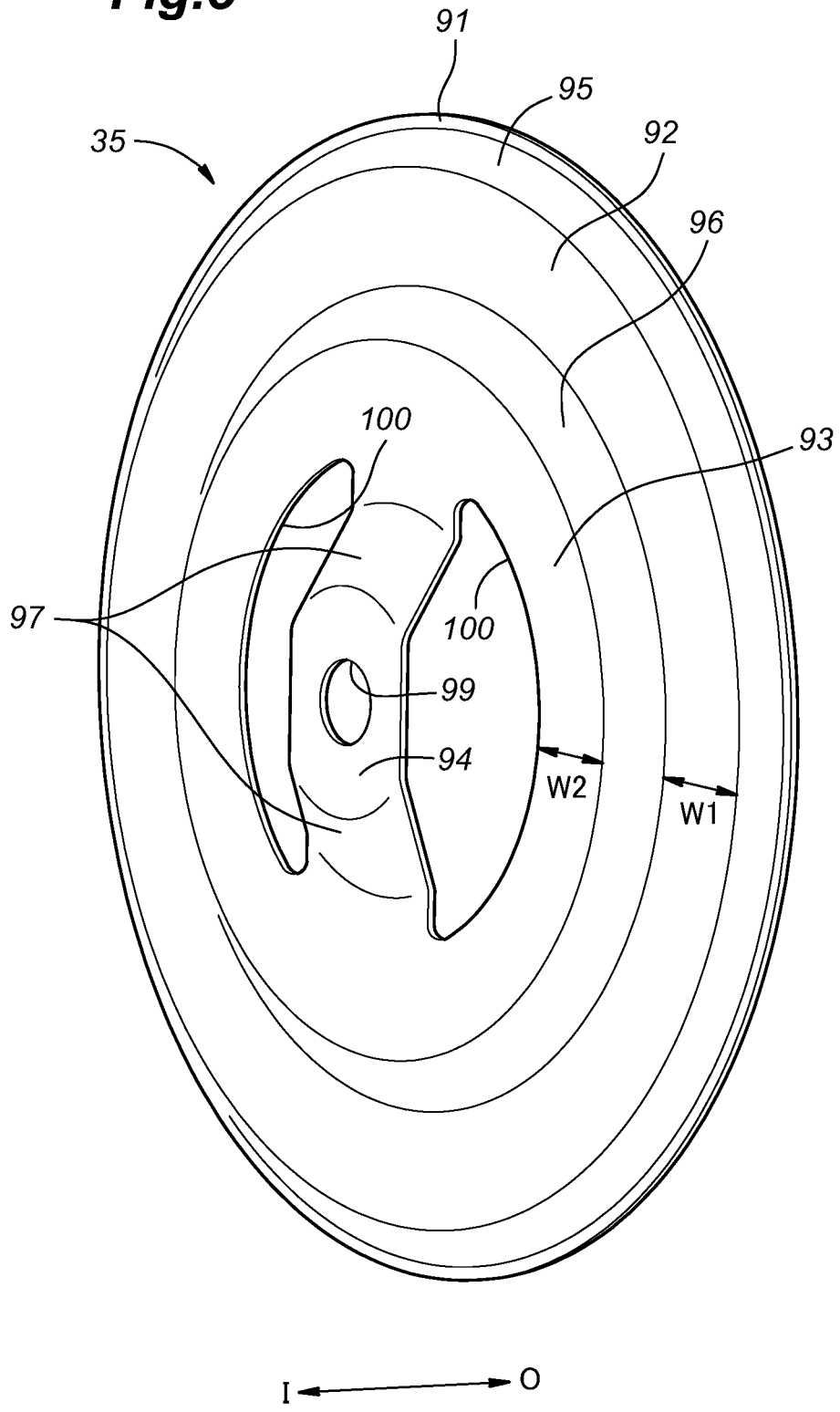
FIG. 5 is a perspective view showing the side disk according to the embodiment of the present invention.

With reference to FIGS. 3 to 5, each side disk 35 is formed of a single sheet metal, and has a disk shape centered on the auger shaft 33. Each side disk 35 is formed of a metal material different from that of the auger claw 34.

Each side disk 35 includes an annular outer circumferential edge portion 91, an annular outer flat plate portion 92 arranged closer to the inside in the lateral direction and the inside in the radial direction than the outer circumferential edge portion 91, an annular inner flat plate portion 93 arranged closer to the inside in the lateral direction and the inside in the radial direction than the outer flat plate portion 92, an annular central flat plate portion 94 arranged closer to the inside in the lateral direction and the inside in the radial direction than the inner flat plate portion 93, an annular outer connecting portion 95 connecting the outer circumferential edge portion 91 and the outer flat plate portion 92, an annular inner connecting portion 96 connecting the outer flat plate portion 92 and the inner flat plate portion 93, and a pair of central connecting portions 97 connecting the inner flat plate portion 93 and the central flat plate portion 94. The outer circumferential edge portion 91, the outer flat plate portion 92, the inner flat plate portion 93, the outer connecting portion 95, and the inner connecting portion 96 are opposed at an interval to the first flat plate portion 46, the second flat plate portion 47, the third flat plate portion 48, the first connecting portion 50, and the second connecting portion 51 of each side plate 42, respectively.

The outer circumferential edge portion 91, the outer flat plate portion 92, the inner flat plate portion 93, and the central flat plate portion 94 are provided along a plane perpendicular to the lateral direction. The outer diameter of the outer flat plate portion 92 is smaller than the outer diameter of the outer circumferential edge portion 91, the outer diameter of the inner flat plate portion 93 is smaller than the outer diameter of the outer flat plate portion 92, and the outer diameter of the central flat plate portion 94 is smaller than the outer diameter of the inner flat plate portion 93. The outer circumferential edge portion 91 is arranged on the same plane as the second flat plate portion 47 of each side plate 42, and the outer flat plate portion 92 is arranged on the same plane as the third flat plate portion 48 of each side plate 42. A circular fitting hole 99 is provided in the center of the central flat plate portion 94. Each outer shaft portion 68 of the auger shaft 33 is fitted into the fitting hole 99. Accordingly, each side disk 35 is fixed to each outer shaft portion 68 and configured to rotate integrally with each outer shaft portion 68 in the first rotational direction R1.

The outer connecting portion 95, the inner connecting portion 96, and the pair of central connecting portions 97 are inclined with respect to a plane perpendicular to the lateral direction. More specifically, the outer connecting portion 95, the inner connecting portion 96, and the pair of central connecting portions 97 are inclined inward in the radial direction toward the inside in the lateral direction. The pair of central connecting portions 97 extend from an outer circumferential edge of the central flat plate portion 94 to the sides opposite to each other, and are connected to an inner circumference edge of the inner flat plate portion 93. A pair of communication openings 100 are formed at intervals in the circumferential direction between the pair of central connecting portions 97.

The width W1 in the radial direction of the outer flat plate portion 92 is wider than the width W2 in the radial direction of the inner flat plate portion 93 (more specifically, a portion of the inner flat plate portion 93 that overlaps with each communication opening 100 in the circumferential direction). In another embodiment, the width W1 in the radial direction of the outer flat plate portion 92 may be approximately equal to the width W2 in the radial direction of the inner flat plate portion 93, or may be narrower than the width W2 in the radial direction of the inner flat plate portion 93.

The surface areas of the outer flat plate portion 92 and the inner flat plate portion 93 are larger than the surface areas of the outer circumferential edge portion 91, the outer connecting portion 95, and the inner connecting portion 96. The distance D1 in the lateral direction between the outer circumferential edge portion 91 and the outer flat plate portion 92 (more specifically, the distance between the center in the thickness direction of the outer circumferential edge portion 91 and the center in the thickness direction of the outer flat plate portion 92: the same will apply to the following) is narrower than the distance D2 in the lateral direction between the outer flat plate portion 92 and the inner flat plate portion 93. The distance D2 in the lateral direction between the outer flat plate portion 92 and the inner flat plate portion 93 is narrower than the distance D3 in the lateral direction between the inner flat plate portion 93 and the central flat plate portion 94.

Figure 6:
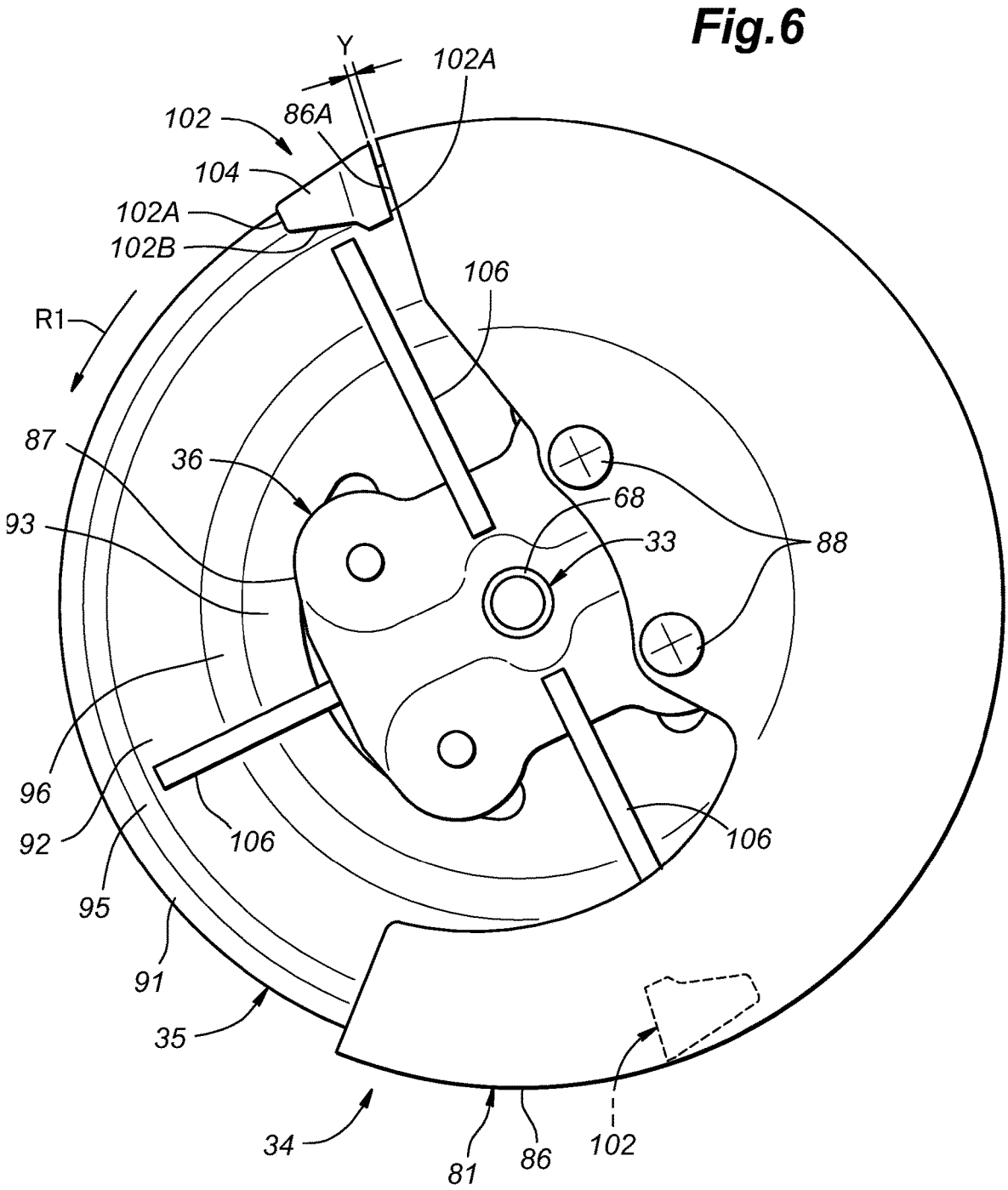
FIG. 6 is a side view showing the side disk and its periphery according to the embodiment of the present invention.
Figure 7:
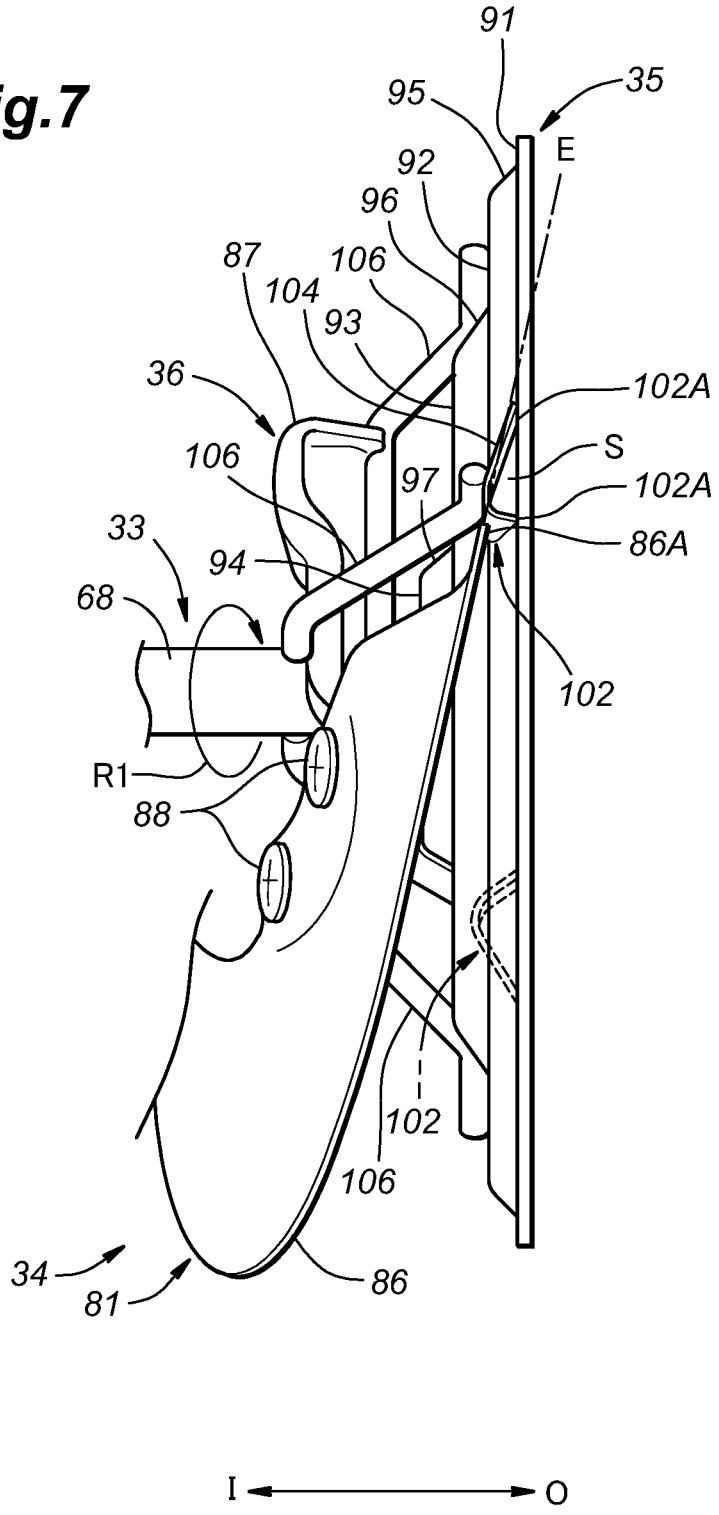
FIG. 7 is a front view showing the side disk and its periphery according to the embodiment of the present invention.

With reference to FIGS. 6 and 7, a pair of auxiliary claws 102 that protrude inward in the lateral direction are provided on an inner surface of the outer circumferential edge portion 91 of each side disk 35. The pair of auxiliary claws 102 are arranged on opposite sides of each outer shaft portion 68 of the auger shaft 33. An outer edge portion of each auxiliary claw 102 protrudes further toward an outer circumferential side than the outer circumferential edge portion 91 of each side disk 35.

Each auxiliary claw 102 is composed of a plate member that curves so as to be convex inward in the lateral direction. That is, each auxiliary claw 102 is formed separately from each side disk 35. Both end portions 102A of each auxiliary claw 102 in the circumferential direction are fixed to the inner surface of the outer circumferential edge portion 91 of each side disk 35 by welding. An inside edge portion 102B of each auxiliary claw 102 in the radial direction is fixed to the outer connecting portion 95 of each side disk 35 by welding. With the above configuration, a space S that opens outward in the radial direction is formed between each side disk 35 and each auxiliary claw 102.

Each auxiliary claw 102 is arranged adjacently to a laterally outside end portion 86A of each outer blade 86 (in FIGS. 6 and 7, only one of the pair of outer blades 86 is shown) that constitutes each outer claw portion 81 of the auger claw 34. More specifically, each auxiliary claw 102 is arranged on an extended line E of the laterally outside end portion 86A of each outer blade 86. With respect to the circumferential direction of the auger shaft 33, each auxiliary claw 102 is spaced at an interval Y from the laterally outside end portion 86A of each outer blade 86. An inner surface of each auxiliary claw 102 is provided with an inclined surface 104. The inclined surface 104 is inclined outward in the lateral direction with respect to the first rotational direction R1 (the rotational direction of each outer blade 86). That is, the inclined surface 104 is inclined in the same direction as each outer blade 86. The angle between the inclined surface 104 and a surface perpendicular to the lateral direction is approximately equal to the angle between the laterally outside end portion 86A of each outer blade 86 and the surface perpendicular to the lateral direction.

Each connecting member 36 of the auger device 7 includes the abovementioned outer bracket 87 and a plurality of ("four" in the present embodiment) connecting shafts 106 extending radially from the outer bracket 87.

The plurality of connecting shafts 106 are arranged at equal intervals in the circumferential direction. One of the plurality of connecting shafts 106 is arranged on the inside of one auxiliary claw 102 in the radial direction so as to overlap with the one auxiliary claw 102 in the circumferential direction. Another of the plurality of connecting shafts 106 is arranged on the inside of the other auxiliary claw 102 in the radial direction so as to overlap with the other auxiliary claw 102 in the circumferential direction.

Each connecting shaft 106 extends in the radial direction in a side view. A radially inside end portion of each connecting shaft 106 is joined (welded) to the outer bracket 87. A radially outside end portion of each connecting shaft 106 is joined (welded) to an inner surface of the outer flat plate portion 92 of each side disk 35.

Next, the operation of the auger device 7 will be described in detail.

As described above, when the crankshaft 11 of the engine 10 rotates, the rotation of the crankshaft 11 is transmitted to the transmission shaft 12 via the speed reduction mechanism (not shown), and the transmission shaft 12 rotates. When the transmission shaft 12 rotates in this way, the first driving gear 61 of the transmission 32, the main shaft portion 66 and the pair of outer shaft portions 68 of the auger shaft 33, the pair of outer claw portions 81 of the auger claw 34, and the pair of side disks 35 rotate integrally in the first rotational direction R1. Accordingly, the snow in front of the snowplow 1 is crushed by the pair of outer claw portions 81 of the auger claw 34 and the pair of side disks 35, and is conveyed toward the lateral center of the auger housing 31.

Further, when the pair of side disks 35 rotate in the first rotational direction R1 as described above, the pair of auxiliary claws 102 provided on the inner surface of each side disk 35 rotate in the first rotational direction R1. Accordingly, the snow that enters the gap between each side disk 35 and each outer claw portion 81 of the auger claw 34 is crushed by the pair of auxiliary claws 102.

Further, when the transmission shaft 12 rotates as described above, each second driving gear 62 of the transmission 32, each inner shaft portion 67 of the auger shaft 33, and each inner claw portion 80 of the auger claw 34 rotate integrally in the second rotational direction R2. That is, each inner claw portion 80 of the auger claw 34 rotates in a direction opposite to each outer claw portion 81 of the auger claw 34 and each side disk 35. Accordingly, the snow in front of the snowplow 1 is crushed by each inner claw portion 80 of the auger claw 34 and conveyed toward the lateral center of the auger housing 31.

As described above, in the auger device 7 according to the present embodiment, the pair of auxiliary claws 102 that protrude inward in the lateral direction is provided on the inner surface of each side disk 35. According to this configuration, the pair of auxiliary claws 102 can crush the snow that enters the gap between each side disk 35 and the auger claw 34. Accordingly, it is possible to suppress a decrease in the work efficiency (the efficiency to crush the snow) of the auger device 7 while spacing each side disk 35 at an appropriate interval (clearance) in the lateral direction from the auger claw 34 when viewed from the front of the plow body 3.

Further, in a case where each side disk 35 is welded to the auger claw 34, it is necessary to replace the auger claw 34 and each side disk 35 together when the auger claw 34 is damaged. By contrast, in the present embodiment, since each side disk 35 is not welded to the auger claw 34, it is possible to replace only the auger claw 34 while leaving each side disk 35 as it is when the auger claw 34 is damaged. Accordingly, it is possible to improve the maintainability of the auger device 7. Further, since each side disk 35 and the auger claw 34 can be made of different materials that cannot be welded together, the flexibility in selecting the materials for each side disk 35 and the auger claw 34 is improved.

Further, each outer blade 86 composing each outer claw portion 81 of the auger claw 34 is inclined outward in the lateral direction with respect to the first rotational direction R1, and each auxiliary claw 102 is arranged adjacently to the laterally outside end portion 86A of each outer blade 86. Accordingly, since the gap between the laterally outside end portion 86A of each outer blade 86 and each auxiliary claw 102 can be narrowed, it is possible to more effectively suppress a decrease in the work efficiency of the auger device 7.

Further, each auxiliary claw 102 is arranged on the extended line E of the laterally outside end portion 86A of each outer blade 86. Accordingly, each outer blade 86 can smoothly convey the snow crushed by each auxiliary claw 102 toward the inside in the lateral direction.

Further, each auxiliary claw 102 is provided with the inclined surface 104 inclined outward in the lateral direction with respect to the first rotational direction R1 (the rotational direction of each outer blade 86). Accordingly, each outer blade 86 can more smoothly convey the snow crushed by each auxiliary claw 102 toward the inside in the lateral direction.

Further, with respect to the circumferential direction, each auxiliary claw 102 is spaced at an interval Y from the laterally outside end portion 86A of each outer blade 86. Accordingly, in a case where each outer blade 86 elastically deforms toward the outside in the lateral direction, it is possible to inhibit the laterally outside end portion 86A of each outer blade 86 from contacting with each auxiliary claw 102.

Further, one of the plurality of connecting shafts 106 is arranged on the inside of the one auxiliary claw 102 in the radial direction, and another of the plurality of connecting shafts 106 is arranged on the inside of the other auxiliary claw 102 in the radial direction. Accordingly, since each connecting shaft 106 is hidden on the inside of each auxiliary claw 102 in the radial direction, each connecting shaft 106 is unlikely to inhibit each auxiliary claw 102 from cutting into the snow surface.

Further, each auxiliary claw 102 is formed separately from each side disk 35 and joined to the inner surface of each side disk 35. Accordingly, it is possible to increase the flexibility in the shape of each auxiliary claw 102 as compared with a case where each auxiliary claw 102 is formed integrally with each side disk 35.

Further, each auxiliary claw 102 is composed of a plate member. Accordingly, it is possible to reduce the weight and cost of each auxiliary claw 102. Further, each auxiliary claw 102 curves so as to be convex inward in the lateral direction, and the space S that opens outward in the radial direction is formed between each side disk 35 and each auxiliary claw 102. Accordingly, it is possible to improve the ability of each auxiliary claw 102 to cut into the snow surface.

Further, the outer edge portion of each auxiliary claw 102 protrudes further toward the outer circumferential side than the outer circumferential edge portion 91 of each side disk 35. Accordingly, since the outer edge portion of each auxiliary claw 102 can contact with the snow surface before each side disk 35 contacts therewith, it is possible to crush the snow efficiently.

Further, in the present embodiment, in a side view, the outer edge portion of each outer blade 86 composing each outer claw portion 81 of the auger claw 34 also protrudes further toward the outer circumferential side than the outer circumferential edge portion 91 of each side disk 35 (see FIG. 6). Accordingly, the outer edge portion of each outer blade 86 can contact with the snow surface before each side disk 35 contacts therewith, it is possible to crush the snow more efficiently.

Figure 8:
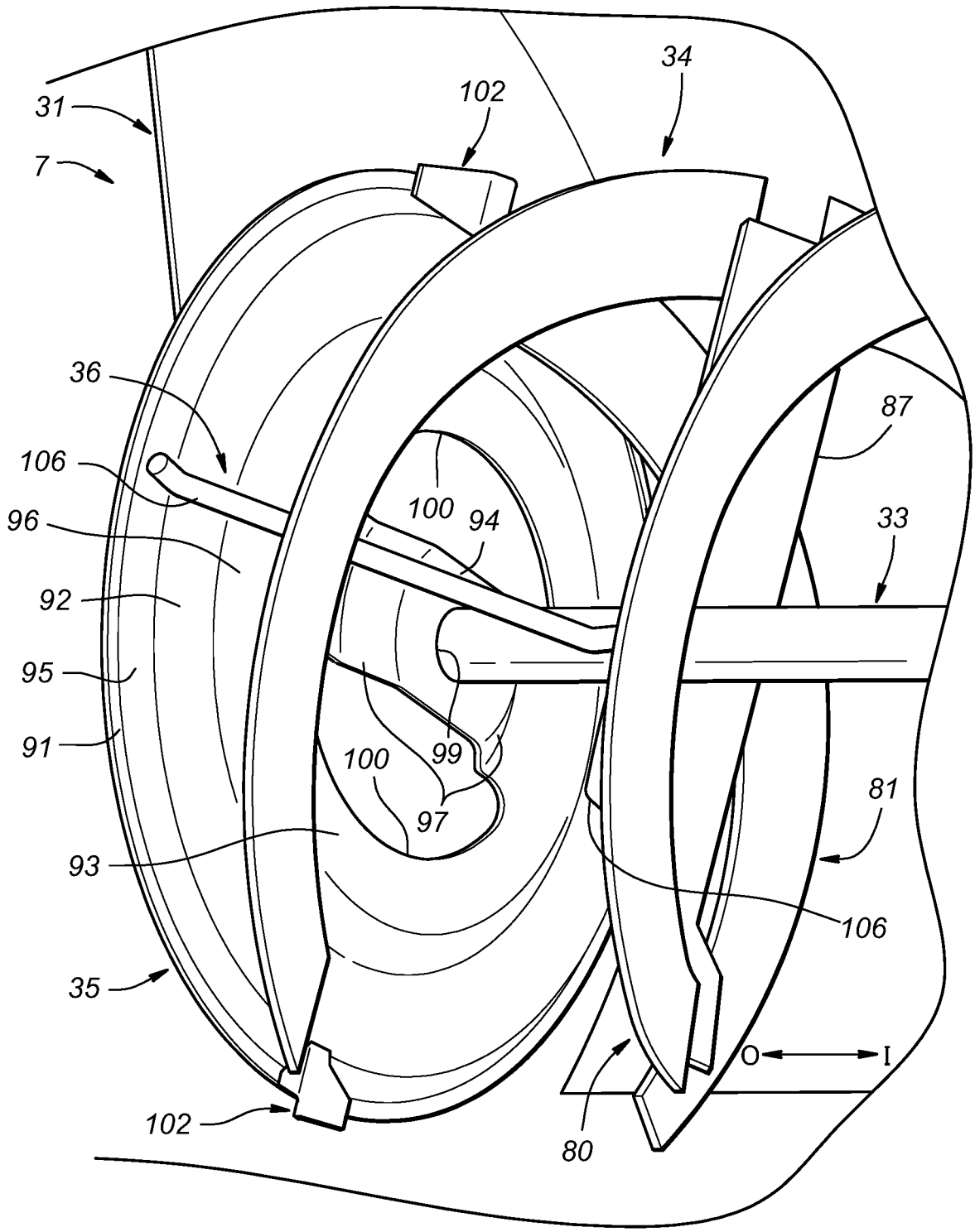
FIG. 8 is a perspective view showing a side disk and its periphery according to another embodiment of the present invention.

In the above embodiment, each inner claw portion 80 and each outer claw portion 81 of the auger claw 34 are spaced at an interval in the lateral direction. On the other hand, in another embodiment, as shown in FIG. 8, as each inner claw portion 80 and each outer claw portion 81 of the auger claw 34 are connected to each other, the auger claw 34 may be continuous in a spiral shape.

In the above embodiment, each connecting member 36 includes the outer bracket 87 and the plurality of connecting shafts 106. On the other hand, in another embodiment, as shown in FIG. 8, each connecting member 36 may include only the plurality of connecting shafts 106. When such a configuration is adopted, the radially inside end portion of each connecting shaft 106 may be directly joined (welded) to the auger shaft 33.

In the above embodiment, the radially outside end portion of each connecting shaft 106 is joined (welded) to the inner surface of the outer flat plate portion 92 of each side disk 35. On the other hand, in another embodiment, the radially outside end portion of each connecting shaft 106 may be joined (welded) to the inner surface of the inner flat plate portion 93 of each side disk 35.

In the embodiment, the outer connecting portion 95 and the inner connecting portion 96 are inclined inward in the radial direction toward the inside in the lateral direction. On the other hand, in another embodiment, the outer connecting portion 95 and the inner connecting portion 96 may be provided parallel to the lateral direction.

In the above embodiment, each auxiliary claw 102 is arranged on the inner surface of the outer circumferential edge portion 91 of each side disk 35. On the other hand, in another embodiment, each auxiliary claw 102 may be arranged on the inner surface of the outer flat plate portion 92 or the inner flat plate portion 93 of each side disk 35.

In the above embodiment, each auxiliary claw 102 is provided separately from each side disk 35. On the other hand, in another embodiment, each auxiliary claw 102 may be provided integrally with each side disk 35.

In the above embodiment, the pair of auxiliary claws 102 are provided on the inner surface of each side disk 35. On the other hand, in another embodiment, only one auxiliary claw 102 or three or more auxiliary claws 102 may be provided on the inner surface of each side disk 35.

In the above embodiment, the engine 10 is used as a drive source for driving the blower device 6 and the auger device 7. On the other hand, in another embodiment, an electric motor may be used as a drive source for driving the blower device 6 and the auger device 7, or both the engine 10 and the electric motor may be used as a drive source therefor.

In the above embodiment, the travel motor 14 is used as a drive source for driving the crawler belt 17 of each travel device 4. On the other hand, in another embodiment, the engine 10 may be used as a drive source for driving the crawler belt 17 of each travel device 4, or both the engine 10 and the travel motor 14 may be used as a drive source therefor.

Concrete embodiments of the present invention have been described in the foregoing, but the present invention should not be limited by the foregoing embodiments and various modifications and alterations are possible within the scope of the present invention.

Glossary of Terms

1: snowplow
7: auger device
31: auger housing
33: auger shaft
34: auger claw
35: side disk
36: connecting member
86: outer blade
86A: laterally outside end portion
91: outer circumferential edge portion
102: auxiliary claw
102A: circumferential both end portions
104: inclined surface
106: connecting shaft
E: extended line
S: space
X: axial line

The invention claimed is:

1. An auger device of a snowplow, comprising:

an auger housing;

an auger shaft supported by the auger housing so as to be rotatable around an axial line extending in a prescribed direction;

an auger claw fixed to the auger shaft; and a pair of side disks arranged on both outsides of the auger claw in the prescribed direction and fixed to the auger shaft, wherein each of the pair of side disks is spaced at an interval from the auger claw, and an auxiliary claw protruding inward in the prescribed direction is provided on an inner surface of each of the pair of side disks, and the auger device further comprises a pair of connecting members connecting the auger shaft and the pair of side disks, wherein each of the pair of connecting members includes a plurality of connecting shafts extending in a radial direction of the auger shaft in a side view, and one of the plurality of connecting shafts is arranged on an inside of the auxiliary claw in the radial direction.

2. The auger device of the snowplow according to claim 1, wherein the auger claw is inclined outward in the prescribed direction with respect to a rotational direction thereof, and the auxiliary claw is arranged adjacently to an end portion of the auger claw on an outside in the prescribed direction.

3. The auger device of the snowplow according to claim 2, wherein the auxiliary claw is arranged on an extended line of the end portion of the auger claw on the outside in the prescribed direction.

4. The auger device of the snowplow according to claim 1, wherein the auxiliary claw is formed separately from each of the pair of side disks and joined to the inner surface of each of the pair of side disks.

5. The auger device of the snowplow according to claim 2, wherein the auxiliary claw is spaced at an interval with respect to a circumferential direction of the auger shaft from the end portion of the auger claw on the outside in the prescribed direction.

6. The auger device of the snowplow according to claim 1, wherein a portion of the auxiliary claw protrudes further toward an outer circumferential side than an outer circumferential edge portion of each of the pair of side disks.

7. An auger device of a snowplow, comprising:

an auger housing;

an auger shaft supported by the auger housing so as to be rotatable around an axial line extending in a prescribed direction;

an auger claw fixed to the auger shaft; and a pair of side disks arranged on both outsides of the auger claw in the prescribed direction and fixed to the auger shaft, wherein each of the pair of side disks is spaced at an interval from the auger claw, and an auxiliary claw protruding inward in the prescribed direction is provided on an inner surface of each of the pair of side disks, wherein the auger claw is inclined outward in the prescribed direction with respect to a rotational direction thereof, and the auxiliary claw is arranged adjacently to an end portion of the auger claw on an outside in the prescribed direction, wherein the auxiliary claw is arranged on an extended line of the end portion of the auger claw on the outside in the prescribed direction, and the auxiliary claw is provided with an inclined surface inclined outward in the prescribed direction with respect to the rotational direction of the auger claw.

8. An auger device of a snowplow, comprising:

an auger housing;

an auger shaft supported by the auger housing so as to be rotatable around an axial line extending in a prescribed direction;

an auger claw fixed to the auger shaft; and a pair of side disks arranged on both outsides of the auger claw in the prescribed direction and fixed to the auger shaft, wherein each of the pair of side disks is spaced at an interval from the auger claw, and an auxiliary claw protruding inward in the prescribed direction is provided on an inner surface of each of the pair of side disks, wherein the auxiliary claw is formed separately from each of the pair of side disks and joined to the inner surface of each of the pair of side disks, wherein the auxiliary claw is composed of a plate member that curves so as to be convex inward in the prescribed direction, and both end portions of the auxiliary claw in a circumferential direction of the auger shaft are joined to the inner surface of each of the pair of side disks, and a space that opens outward in a radial direction of the auger shaft is formed between each of the pair of side disks and the auxiliary claw.

* * * * *